United States Patent [19]

Brown

[11] Patent Number: 4,864,749

[45] Date of Patent: Sep. 12, 1989

[54] TAG FOR IDENTIFYING SURVEY TRAVERSE POINTS

[76] Inventor: David C. Brown, 4751 State Rte. 34, Winfield, W. Va. 25213

[21] Appl. No.: 177,739

[22] Filed: Apr. 5, 1988

[51] Int. Cl.[4] ..... G09F 3/100

[52] U.S. Cl. ..... 40/299

[58] Field of Search ..... 40/299, 594; 116/209, 116/DIG. 14; 33/293

[56] References Cited

U.S. PATENT DOCUMENTS 1,186,382 6/1916 Daly ..... 40/299
3,126,861 3/1964 Sheinwald ..... 116/209
3,568,626 3/1971 Southworth, Jr. ..... 116/209
4,677,010 6/1987 Selwyn ..... 40/299

*Primary Examiner*—Gene Mancene
*Assistant Examiner*—Cary E. Stone
*Attorney, Agent, or Firm*—Jim Zegeer

[57] ABSTRACT

An alphanumeric identification device for land and construction survey traverse control points comprised of a fluorescent plastic tag with metal detector electronic signal return to enhance location of said point. Each tag has a unique, highly visible alphanumeric indicia thereon which are in a sequential order and in sets to provide an accurate record of the number assigned to each central point.

8 Claims, 2 Drawing Sheets

TAG FOR IDENTIFYING SURVEY TRAVERSE POINTS

BACKGROUND OF THE INVENTION

This invention relates to a tag for identifying wooden stakes used in land and construction surveying in a convenient and neat manner and provide an electronic signal return to the wooden stake to facilitate location of the traverse point by use of a metal detector.

THE PRIOR ART

Field traverses used for property and construction surveys require a series of field reference points. Briefly, the point is generally a 2"×2" wood hub or 2'×¾" wood stake driven into the soil with a tack driven in to the top surface of the wood stake to more exactly define the point. The vertical axis of the angle measuring unit, a transit, theodolite or total station machine is centered over the tack, then the horizontal and vertical angles and distance is measured between the fore and back points. This angle and distance information is used in a coordinate geometry survey program to create north-south and east-west coordinates for each point (the tack in the wood hub or stake). The point information is used to determine property line and corner locations, road cut edges, center line location, etc. depending on the surveyor's purpose.

The traverse survey often will require over one hundred points. The method common in the trade of labeling these temporary points is to write a number on the side of the hub or drive a second stake near the hub and print the location number on it. Generally a felt tip marker is used and legibility of the number depends on the drafting talent of the person marking the point. Threes and eights and sevens and ones tend to look similar, offering a source of error.

The problem from this method is the number quickly becomes illegible as the stake weathers or the side stake is damaged or lost. In addition, the hub is usually driven flush with the ground surface for protection. If a hub is covered through an accident or by a natural event, for example leaves, the initial survey work will have to be repeated to locate the hub before the survey can be finished. "Metal detectors" have great difficulty finding the weak electronic signal return of the metal tack.

SUMMARY OF THE INVENTION

Therefore, this invention provides a method of avoiding these problems by creating a uniform, consistent size, high visibility, weather resistant alphanumeric tag with an electronic signal return.

The invention is a composite tag set of brilliant fluorescent or other colored polyvinylchloride, polypropylene or other suitable polymer containing particles or layers of aluminum, iron, magnetite or other metallic material, which, in one preferred embodiment, are made from a sheet perforated or scored into a 0.75 inch by 1.50 inch grid, each of which constitutes a tag. The fluorescent color provides good daylight visibility to aid locating the traverse point. The aluminum, iron or magnetite particles and or layers, provide a means of returning a signal to a sensor such as a beat frequency oscillator (BFO) or transmitter-receiver (TR) type metal detectors common to survey crews.

A grid of perforation in the sheet, or connecting tabs between tags, creates an easily removed tag of "plastic" 0.75 inch by 1.50 inch with 80 tags in a sheet in rows of 10 and in columns of 8, the sheet would be about 12" by 7.5" which size is easily and conveniently handled by the survey crew. However, they could be formed into a coil and sequentially dispersed from a dispenser. Centered on the top surface of each tab, the area defined by the perforations grid, is printed or embossed one to four digit number and or letters in high visibility ink, which may incorporate magnetically responsive ink particles. In addition, a small hole or depression is centered in each tab to provide a guide for the survey tack.

PREFERRED EMBODIMENT OF THE INVENTION

Figure 1A:
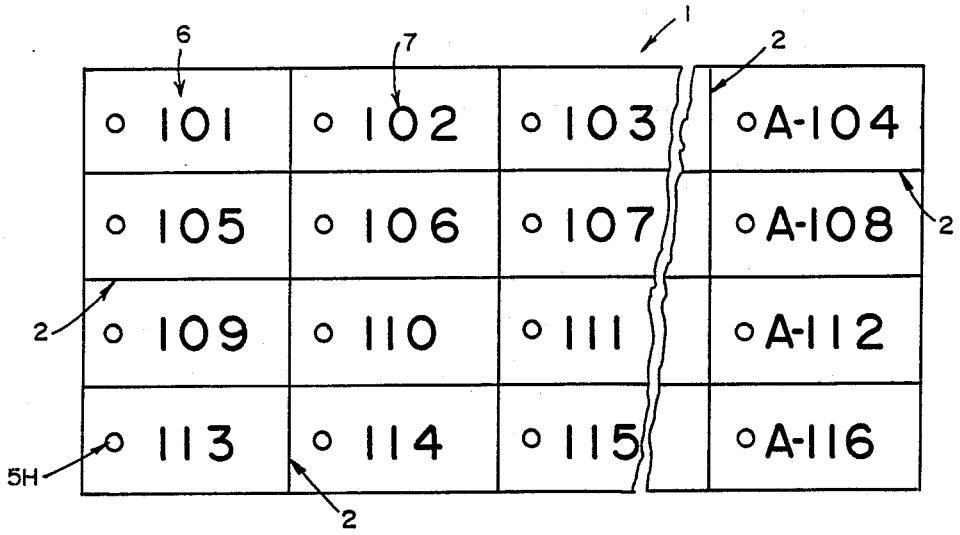
FIG. 1*a* shows a top plan
Figure 1B:
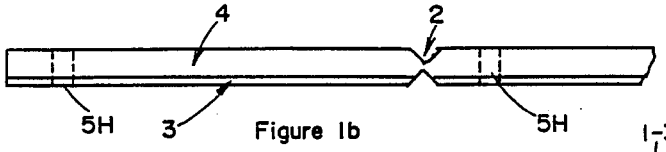
FIG. 1*b* shows an enlarged cross-sectional view

In FIG. 1*a*, the invention is shown as a rectangular grid or matrix 1 of approximately twenty-five mils thick plastic, perforated to create a breakaway, lines or score lines 2 on 0.75" by 1.5" centers. A pressure sensitive adhesive coated layer of aluminum foil 3 is applied to the underside of the survey tag as shown in FIG. 1*b*. A depression 5 is formed in the center of each tag 6 to serve as a centering guide for the survey tack.

Figure 3A:
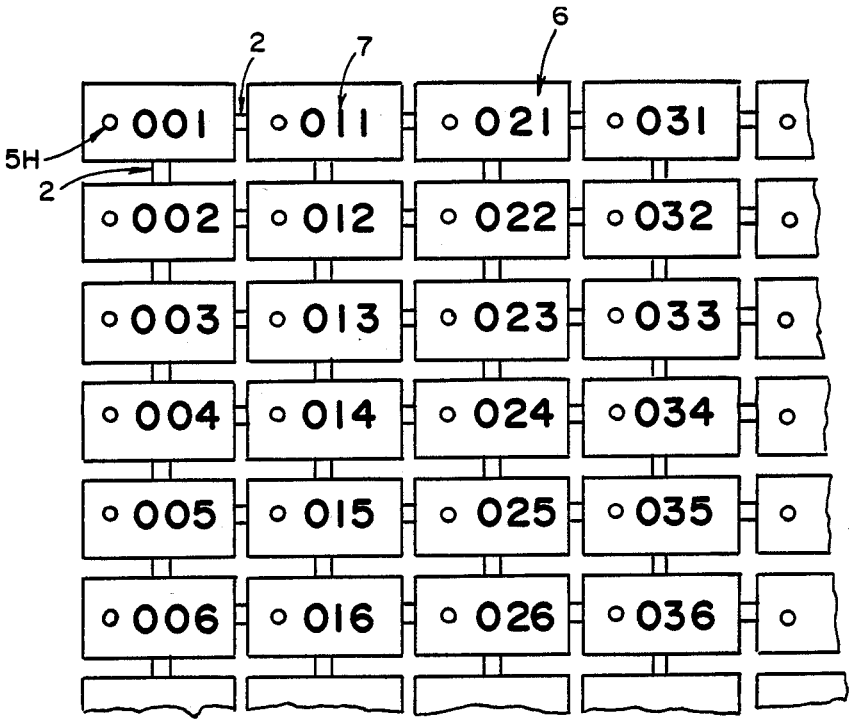
FIG. 3*a* is a top plan view of injection molded embodiment of the invention and FIG. 3*b* is a sectional view thereof.
Figure 3B:
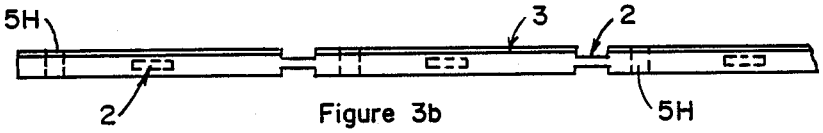

In the embodiment of FIGS. 1*a* and 3*a*, the invention is formed from a sheet 4 of polyvinylchloride, poly propylene, polyethylene, polystyrene, ABS, acetals or polycarbonate containing 0.005 to 0.001 unit of fluorescent pigment per unit of polymer. The embodiment shown in FIG. 1*a* is a polyethylene containing 0.4 percent by weight of either Flare 910 Series Daylight Pink 1 Fluorescent Pigment (Cleveland Pigment and Color Company) or Keyplast Pink FFD Super-SRL 608-001090 (Keystone Aniline Corporation) to provide a fluorescent color to the tag. Other suitable fluorescent pigments and dyes are commercially available from Radiant Color and Day Glo Corporation.

The device is assembled using extrusion, injection molding film extrusion, calandering, plastisol spread coating, rotational casting, sheet coating, layering, perforation, embedment, printing and surface finishing methods well known to and commercially available from those skilled in the manufacturing of composite printed sheet material.

Figure 1C:
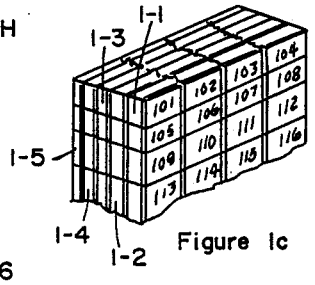
FIG. 1*c* is a perspective view of a set of surveyors number tags incorporating the invention.

The embodiment shown in FIG. 1*a* has Helvetica medium style numbers of 36 point size printed on the fluorescent sheet using a permanent black ink, which preferably is of the type used to print magnetically readable characters, and/or paint chemically compatible with the polymer used to form the fluorescent sheet. The alphanumeric print 7 may be embossed, imprinted, painted or printed on the tag 6 surface of the fluorescent sheet. The color, size and style of number and letter may be any that will fit on the tag and may be set off from tack guide 5H so that the tack head will not obliterate any numeral or letter. Normally the sheets will be packed in sets of five sheets, 1-1, 1-2, 1-3, 1-4 and 1-5 (see FIG. 1*c*) numbered from 1 to 80, 81 to 160, 161 to 240, 241 to 320, and 321 to 400, respectively. The sheets may be in different colors, such as fluorescent pink, fluorescent orange, fluorescent yellow and fluorescent blue, however, other colors can be used. By using different background colors, one letter and four digits, over a hundred thousand different identities are readily available for traverse points.

Figure 4:
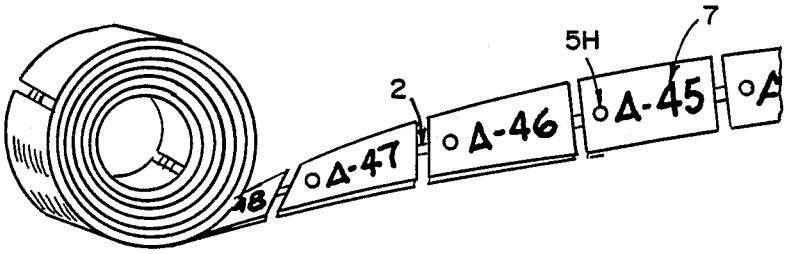
FIG. 4 shows a roll of tag markers according to invention for issuance from a dispenser.

The thickness of the tag 6 can be varied from 10 mil to 100 mil to meet the surveyors requirement for appearance and durability. The thicker tags will last longer and are more suitable for use with concrete nails. However, the thinner material can be coiled as shown in FIG. 4 and issued from a dispenser (not shown).

The electronic signal return means for the "metal" detector, is shown as a heavy aluminum foil layer 3 attached to the underside of the tag 6 in FIG. 1*a*. Other methods of returning the "metal" detector's signal include adding ten to thirty percent by weight of aluminum, iron or magnetite particles to the fluorescent polymer material 4 or a grid (0.03"c.c.) of small (30–36 gage) wires of aluminum, brass or iron embedded in the center of the polymer sheet 4, so as to be present in relatively uniform amounts in each tag.

Figure 2:
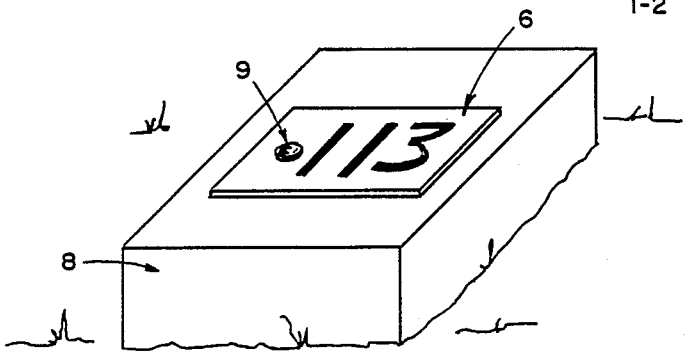
FIG. 2 shows a prospective of a traverse point assembly from a 2×2 inch wood hub, the invention and survey tack.

The method of use, as shown in FIG. 2, is for the forward rodman to drive the hub 8 into the ground, snap off the proper number tag 6, place on top of the hub and fasten with the stake tack 9.

While I have shown and described the invention in detail, it will be appreciated that various modifications and adaptations will be obvious to those skilled in the art and it is intended that such obvious modifications and adaptations be encompassed within the spirit and scope of the invention as defined in the claims appended hereto.

What is claimed is:

1. A surveyors stake marker comprising, in combination, a weather resistant plastic frame, said plastic frame being a plurality of flat tags joined at their mutually contiguous edges by integrally formed manually severable connecting means, each said flat tag including a fluorescent pigment therein, each said tag incorporating an electro-responsive material for inducing a large signal in a electro-responsive sensor mechanism, a guide means for a surveyor's tack formed in one surface of each flat tag, and each flat tag having a unique alphanumeric indicia on said one surface with the numbers being in a predetermined sequence.

2. The surveyor's stake marker as defined in claim 1 wherein said alphanumeric indicia are numbers and each of said tags has a different number in a predetermined sequence of numbers.

3. The surveyor's stake marker as defined in claim 1 wherein said guide means is a preformed hole.

4. The surveyors stake marker as defined in claim 1 wherein each said magnetically responsive material is a layer of material selected from the group consisting of aluminum, iron, copper mesh, magnetite.

5. The surveyors stake marker as defined in claim 1 wherein there are a set of said plastic frames with each frame having a fluorescent pigment which is different from the fluorescent pigments of the other frames of said set, respectively, and the alphanumeric indicia on all of said sets constituting a full uninterrupted sequence of said indicia.

6. A system of marking survey stakes comprising a plurality of thin flat fluorescent plastic tags, said plurality of fluorescent plastic tags being permanently marked with sequential alphanumeric indicia, respectively, so that each fluorescent plastic tag has a unique indicia thereon, said indicia being in high contrast to each said fluorescent plastic tag, each fluorescent plastic tag having a electro-responsive material incorporated therein which provides a return field to a sensing field of a metal detector, whereby each tag (1) is highly visible, (2) has a unique alphanumeric indicia thereon, (3) is electro- responsive so that it can be easily located by a metal detector, and means forming a guide means for a tack to securely fasten said tags to a surveyor's stake.

7. The system defined in claim 6 wherein said markers are tab connected plastic tags constituting a frame, each frame having a predetermined consecutive sequence of alphanumeric indicia on the individual ones of said plastic tags whereby in a given survey it is ensured that one alphanumeric indicia will be attached to a survey stake and control point only once.

8. The system defined in claim 7 wherein these are a plurality of frames of said connected plastic tags with each frame being formed from a different colored fluorescent plastic, and having a different consecutive sequence of alphanumeric indicia.

* * * * *